US012279688B1

(12) United States Patent
Pineda

(10) Patent No.: US 12,279,688 B1
(45) Date of Patent: Apr. 22, 2025

(54) TACTICAL PANTS WITH ATTACHABLE HARNESS

(71) Applicant: HK Army, Inc., Signal Hill, CA (US)

(72) Inventor: Jason Jeremiah Pineda, Signal Hill, CA (US)

(73) Assignee: HK Army, Inc., Signal Hill, CA (US)

( * ) Notice: Subject to any disclaimer, the term of this patent is extended or adjusted under 35 U.S.C. 154(b) by 0 days.

(21) Appl. No.: 18/588,929

(22) Filed: Feb. 27, 2024

(51) Int. Cl.
*A45F 5/02* (2006.01)
*A41D 1/06* (2006.01)
*A45F 3/00* (2006.01)

(52) U.S. Cl.
CPC ..... *A45F 3/00* (2013.01); *A41D 1/06* (2013.01); *A41D 2400/48* (2013.01); *A45F 2003/003* (2013.01); *A45F 2200/0591* (2013.01)

(58) Field of Classification Search
CPC . A41D 1/06; A41D 2400/48; A45F 2003/003; A45F 2200/0591; A45F 3/00; A45F 2003/008; A45F 3/005; A45F 5/021; Y10S 224/931; Y10S 224/904; F42B 39/02; A61F 5/028; A62B 17/001
USPC ..... 224/576
See application file for complete search history.

(56) References Cited

U.S. PATENT DOCUMENTS

| | | | | |
|---|---|---|---|---|
| 5,988,315 | A * | 11/1999 | Crane | A62B 35/0018 182/3 |
| 6,108,819 | A * | 8/2000 | DeBaene | A41D 1/067 2/237 |
| 6,390,348 | B1 * | 5/2002 | Godshaw | B25H 3/00 224/660 |
| 6,843,399 | B2 * | 1/2005 | Garcia | F42B 39/02 224/679 |
| 9,339,102 | B2 | 5/2016 | Iosilevich et al. | |
| 9,581,414 | B1 | 2/2017 | Mironski | |
| 11,497,279 | B2 | 11/2022 | Kirsch | |
| 2007/0079426 | A1 | 4/2007 | Mainor | |
| 2012/0158041 | A1 | 6/2012 | Craig | |
| 2014/0075650 | A1 | 3/2014 | Garrison et al. | |
| 2017/0065066 | A1 * | 3/2017 | Hintze | B25H 3/00 |

* cited by examiner

*Primary Examiner* — Derek J Battisti
*Assistant Examiner* — Matthew T Theis
(74) *Attorney, Agent, or Firm* — Knobbe, Martens, Olson & Bear, LLP

(57) ABSTRACT

A tactical harness system may include a harness and a pad. The pad may removably couple to the harness. The pad may removably couple to pants to prevent or inhibit the harness from shifting when the harness is worn by a user. The harness may include one or more equipment fasteners configured to couple equipment to the harness. The pad may include a fastener that may couple the pad to fasteners on the waistband of the tactical.

15 Claims, 7 Drawing Sheets

TACTICAL PANTS WITH ATTACHABLE HARNESS

CROSS-REFERENCE TO RELATED APPLICATIONS

Any and all applications for which a foreign or domestic priority claim is identified in the Application Data Sheet as filed with the present application are hereby incorporated by reference under 37 CFR 1.57

BACKGROUND

Field

The present disclosure is directed to tactical pants, and more particularly to tactical pants with an attachable harness.

Description

Harness system may be worn with tactical pants (e.g., paintball pants, airsoft pants, or military pants), in order to hold equipment or ammunition. Harness systems are wrapped around the waist or abdomen of the user and, typically, these harness systems are not attached directly to the tactical pants. Therefore, when a user walks, runs, or crawls, the harness system may shift up and down and/or side to side. Furthermore, the harness may rotate around the user's waist. The shifting of the harness may cause the user's tactical pants to ride up or slide down, distracting the user from a mission objective or a paintball or airsoft game.

SUMMARY

For purposes of this summary, certain aspects, advantages, and novel features are described herein. It is to be understood that not necessarily all such advantages may be achieved in accordance with any particular embodiment. Thus, for example, those skilled in the art will recognize the disclosures herein may be embodied or carried out in a manner that achieves one or more advantages taught herein without necessarily achieving other advantages as may be taught or suggested herein.

In accordance with one aspect of the disclosure, a tactical harness system can include a harness with fasteners that can couple to fasteners on the waistband of tactical pants in order to prevent or inhibit movement of the harness relative to the tactical pants.

In accordance with one aspect of the disclosure, a tactical harness system can include a harness including one or more equipment fasteners configured to couple equipment to the harness; a pad configured to removably couple to the harness, the pad can include a fastener configured to couple the pad to fasteners on a waistband of tactical pants when the harness is positioned around the waistband, such that the pad can be interposed between the waistband and the harness.

In accordance with one aspect of the disclosure, the harness can include straps configured to wrap around the waistband of the tactical pants.

In accordance with one aspect of the disclosure, the fastener of the pad can include a hook and loop fastener.

In accordance with one aspect of the disclosure, the harness can include a fastener configured to removably couple the pad to the harness.

In accordance with one aspect of the disclosure, the fastener of the pad can be a first fastener positioned on a first side of the pad, the pad can include a second fastener on a second side of the pad, and the second fastener can be configured to removably couple with the fastener of the harness.

In accordance with one aspect of the disclosure, the pad can include a third fastener and the harness can include a second fastener, and the third fastener of the pad can be configured to couple with the second fastener of the harness.

In accordance with one aspect of the disclosure, the pad can cover a portion of a back of a user when the pad is coupled to the waistband of the tactical pants.

In accordance with one aspect of the disclosure, the harness can include padding.

In accordance with one aspect of the disclosure, a tactical harness system can include a harness including straps configured to wrap around a user to couple the harness to the user, a first attachment portion, and one or more equipment fasteners configured to couple equipment to the harness; a pad including a second attachment portion and a third attachment portion; pants including a waistband and a fastener positioned on a back on the waistband, the first attachment portion can configured to couple with the second attachment portion to couple the pad to the harness, and the third attachment portion can be configured to couple with the fastener of the pants so couple the pad to the pants.

In accordance with one aspect of the disclosure, the first attachment portion, the second attachment portion, and the third attachment portion can include hook and loop fasteners.

In accordance with one aspect of the disclosure, the first attachment portion and the third attachment portion can each include a loop portion of a hook and loop fastener, and the second attachment portion and the fastener can each include a hook portion.

In accordance with one aspect of the disclosure, the pad can align with a lower back of the user when the pad is coupled to the pants.

In accordance with one aspect of the disclosure, the pants can include a belt.

In accordance with one aspect of the disclosure, leg portions of the pants can include reinforced portions extending over at least a portion of the leg portion that aligns with a knee of a user.

In accordance with one aspect of the disclosure, the pants can include pockets in leg portions of the pants.

In accordance with one aspect of the disclosure, a tactical harness system can include a harness, the harness can be configured to removably couple to pants in order to prevent or inhibit the harness from shifting relative to the pants when the harness is positioned around a user.

In accordance with one aspect of the disclosure, the harness can include one or more attachment portions configured to removably couple to fasteners on a waistband of the pants.

In accordance with one aspect of the disclosure, the tactical harness system can further include a pad removably coupled to the harness, the pad can be configured to removably couple the harness to the pants.

In accordance with one aspect of the disclosure, the pad can include padding positioned over a back of a user when the pad is coupled to the pants.

In accordance with one aspect of the disclosure, the pad can be coupled to a waistband of the pants.

BRIEF DESCRIPTION OF THE DRAWINGS

Various embodiments are depicted in the accompanying drawings for illustrative purposes and should in no way be interpreted as limiting the scope of the embodiments. Furthermore, various features of different disclosed embodiments can be combined to form additional embodiments, which are part of this disclosure.

DETAILED DESCRIPTION

Although several embodiments, examples, and illustrations are disclosed below, it will be understood by those of ordinary skill in the art that the system, methods, and devices described herein extend beyond the specifically disclosed embodiments, examples, and illustrations and includes other uses of the system, methods, and devices and obvious modifications and equivalents thereof. Embodiments of the disclosure are described with reference to the accompanying figures, wherein like numerals refer to like elements throughout. The terminology used in the description presented herein is not intended to be interpreted in any limited or restrictive manner simply because it is being used in conjunction with a detailed description of certain specific embodiments of the disclosure. In addition, embodiments of the disclosure can include several novel features and no single feature is solely responsible for its desirable attributes or is essential to practicing the system, methods, and devices herein described.

Figure 1A:
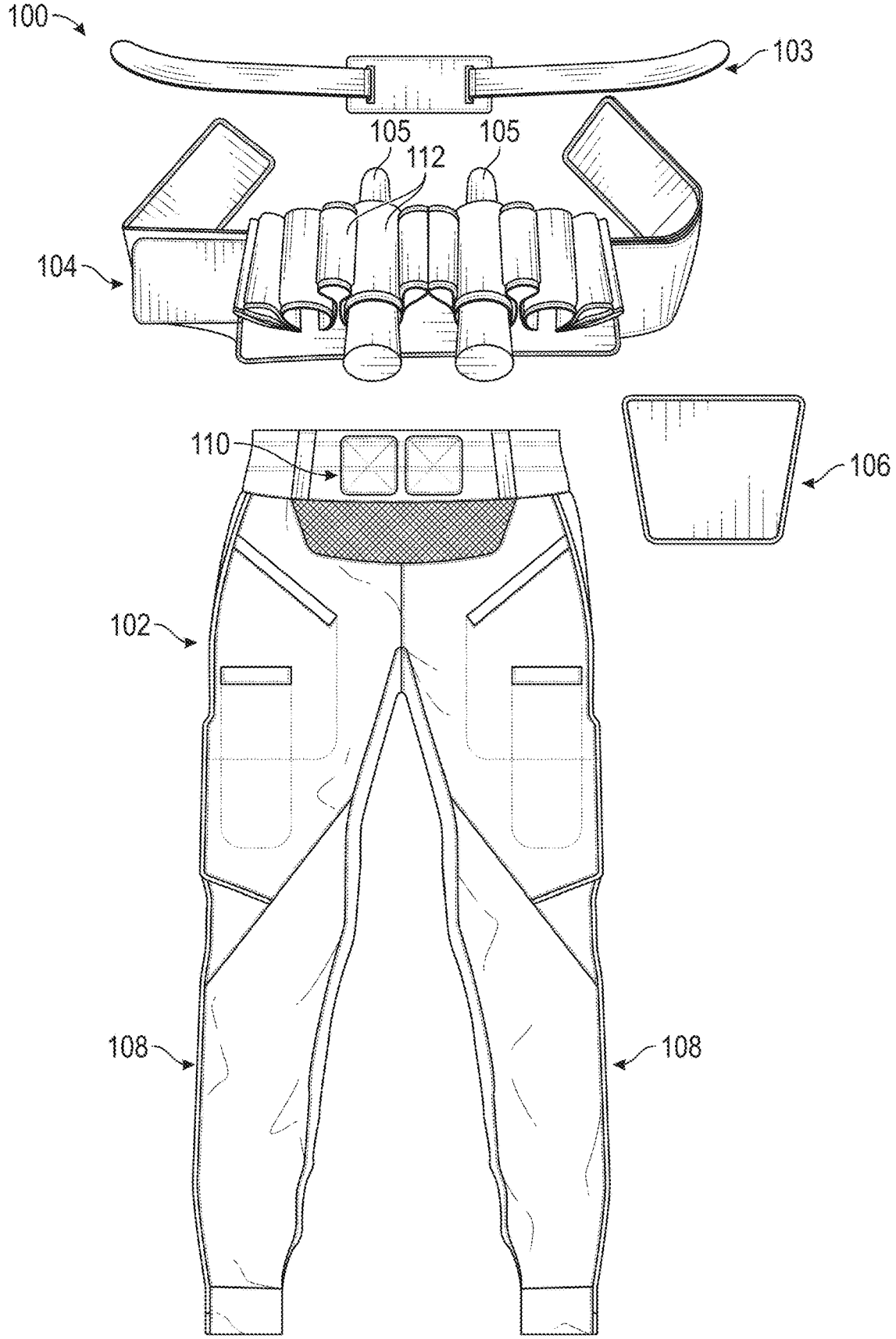
FIG. 1A illustrates a tactical harness system with tactical pants and a harness.
Figure 1B:
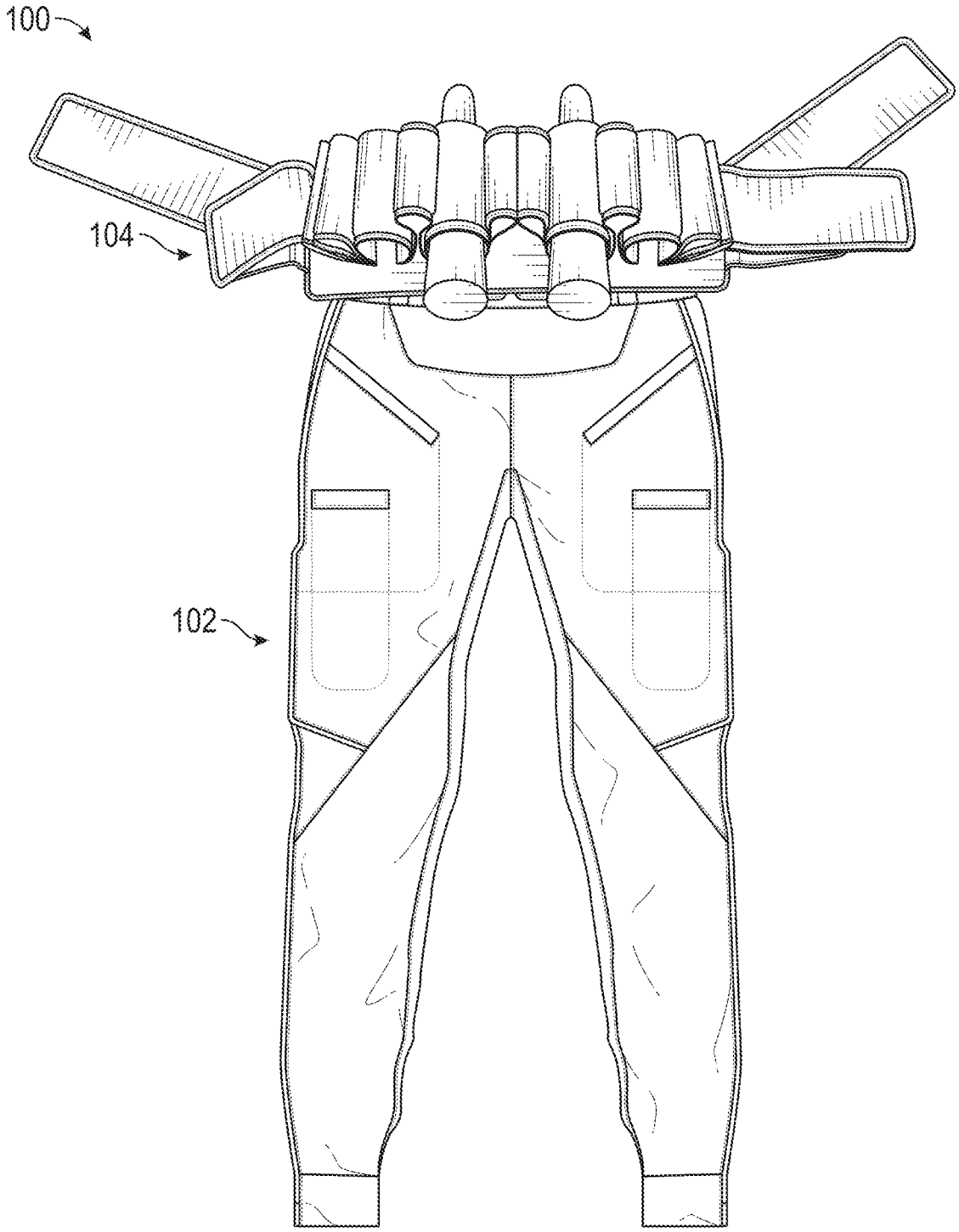
FIG. 1B illustrates the tactical harness system of FIG. 1A with the harness coupled to the pants.

FIGS. 1A and 1B illustrate a tactical harness system 100. As shown in FIG. 1A, the tactical harness system 100 may include pants (referred to herein as tactical pants) 102, a harness 104, and/or a pad 106. The tactical pants 102 may include leg portions 108 and a waistband 110. In some embodiments, the tactical harness system 100 may include a belt 103. The belt 103 may be removably positioned around the waistband 110 in order to secure the tactical pants 102 on a user. The harness 104 may include one or more equipment fasteners 112. The equipment fasteners 112 may removably couple equipment 105 to the harness 104. In some embodiments, the equipment 105 may include ammunition, ammo pods, gun or marker components, and/or any other equipment. In some examples, the equipment 105 can be tubes (e.g., filled with paintballs, airsoft balls, etc.) and the equipment fasteners 112 can be hoops (e.g., elastic hoops) that receive and resiliently retain the tubes on the harness 104. In some embodiments, the pad 106 may be removably coupled to the harness 104. As shown in FIG. 1B, the harness 104 may be coupled to the waistband 110 of the tactical pants 102 (e.g., coupled to a rear side of the tactical pants 102). In some embodiments, the harness 104 may be directly coupled (e.g., removably coupled) to the waistband 110 of the tactical pants 102. In some embodiments, the pad 106 (not shown in FIG. 1B) may be positioned between the harness 104 and the tactical pants 102. The pad 106 may include padding that may protect a tailbone and/or a lower back of the user. The pad 106 can facilitate (e.g., aid) retaining the harness 104 against the tactical pants 102 and inhibit (e.g., prevent) movement of the harness 104 relative to the tactical pants during use (e.g., while the user is running, crawling, jumping during a paintball or airsoft game).

Figure 2B:
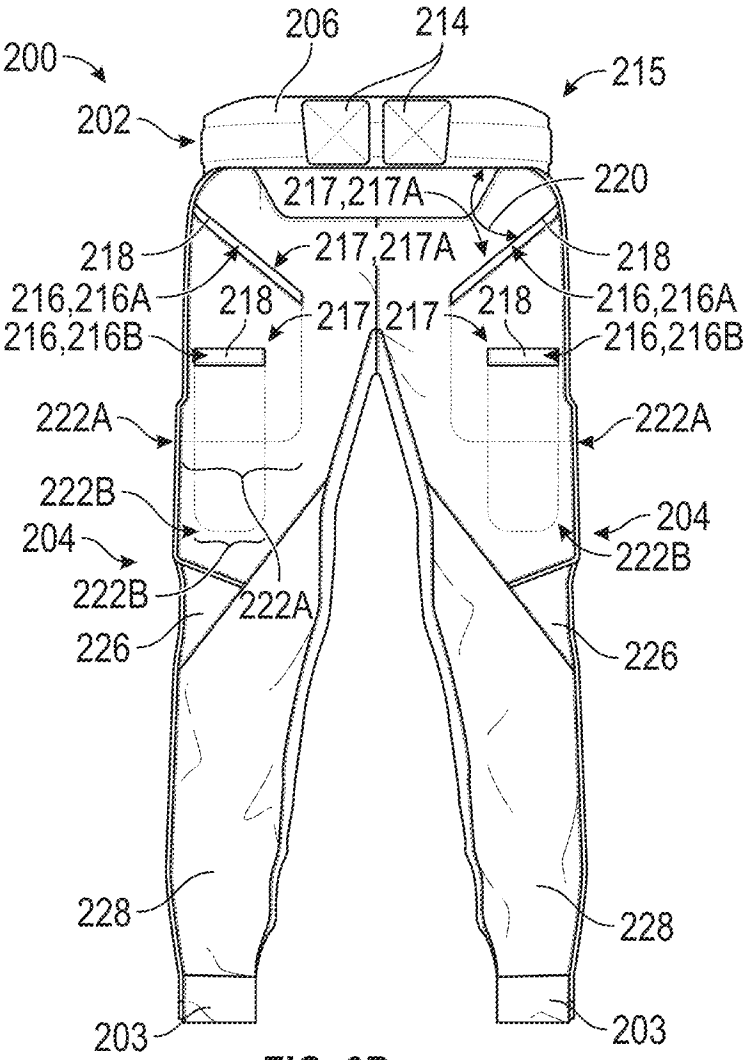
FIG. 2B illustrates a back view of the tactical pants of FIG. 2A.
Figure 2A:
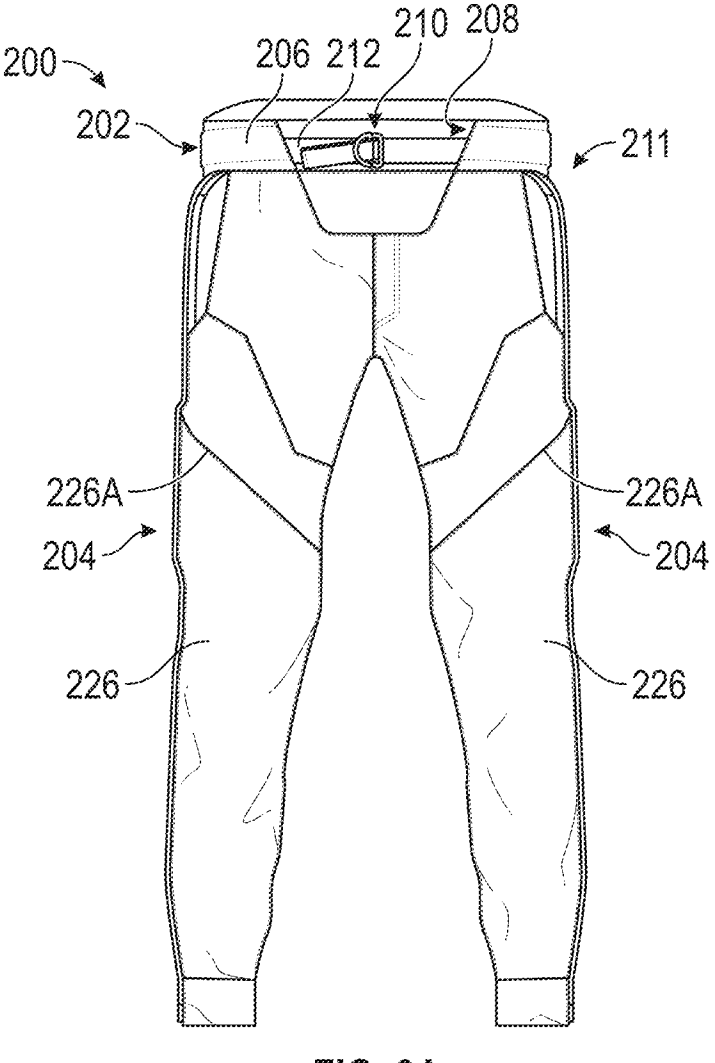
FIG. 2A illustrates a front view of tactical pants of a tactical harness system.

FIGS. 2A and 2B illustrate an embodiment of tactical pants 200 for a tactical harness system, such as tactical harness system 100. The tactical pants 102 in FIGS. 1A and 1B may have any of the features of the tactical pants 200, and the tactical pants 200 may have any of the features of the tactical pants 102 except the differences described with reference to FIGS. 2A and 2B.

In some embodiments, the tactical pants 200 may include a waistband 202 and leg portions 204. The tactical pants 200 may include a panel 206 coupled to the waistband 202. In some embodiments, the waistband 202 and/or the panel 206 may be elastic or stretchable. The waistband 202 and the panel 206 may form a channel 208 extending around at least a portion of the waistband 202. In some embodiments, the tactical pants 200 may include a belt 212. The belt 212 may be removably positioned around the waistband 202. The belt 212 may be tightened and/or loosened around the waistband 202. Accordingly, a user may tighten the belt 212 to secure the waistband 202 of the tactical pants 200 to a waist of the user and the user may loosen the belt 212 to loosen the waistband 202 of the tactical pants 200 to allow the user to remove the tactical pants 200. In some embodiments, the belt 212 may be positioned in the channel 208 so the panel 206 is positioned over the belt 212. The panel 206 may prevent or inhibit the belt 212 from moving off the waistband 202 (or prevent the belt 212 from catching on an object, such as a branch, when a user is in close proximity with trees, shrubs, fences or other objects). The panel 206 and the channel 208 may extend around the waistband 202 except for a portion 210 of the waistband 202 on a font 211 of the tactical pants 200. Accordingly, a user may access the belt 212 at the portion 210 in order to tighten and/or loosen the belt 212.

In some embodiments, as shown in FIG. 2B, the tactical pants 200 may include one or more fasteners 214. In some embodiments, the tactical pants 200 may include one (1) fastener 214, two (2) fasteners 214, three (3) fasteners 214, four (4) fasteners 214, five (5) fasteners 214, six (6) fasteners 214, seven (7) fasteners 214, eight (8) fasteners 214, nine (9) fasteners 214, and/or ten (10) fasteners 214. The fasteners 214 may be positioned on the waistband 202 and/or the panel 206. The fasteners 214 may be positioned on a back 215 of the tactical pants 200. The fasteners 214 may be sewn, glued, and/or otherwise coupled to the waistband 202 and/or the panel 206. The fasteners 214 may include a magnet, a snap fastener, a button, a buckle, a hook and loop fastener, such as Velcro® hook and loop fastener, and/or any other type of fastener. In some embodiments, the fasteners 214 may include a hook portion of a hook and loop fastener. In other embodiments, the fasteners 214 may include a hoop portion of a hook and loop fastener.

In some embodiments, as shown in FIG. 2B, the leg portions 204 may include one or more pockets 216. In some embodiments, each leg portion 204 may include one (1)

pocket 216, two (2) pockets 216, three (3) pockets 216, four (4) pockets 216, and/or five (5) pockets. In some embodiments, an edge 218 of openings 217 to the pockets 216 may be elastic or flexible. The edge 218 may keep the openings 217 closed. The edge 218 may prevent or inhibit objects positioned in the pockets 216 from falling out of the pockets 216. The edge 218 may prevent or inhibit dust, dirt, and/or debris from entering the pockets 216.

In some embodiments, each leg portion 204 may include a first pocket 216A and a second pocket 216B. The first pocket 216A may be positioned between the waistband 202 and the second pocket 216B. An opening 217A to the first pocket 216A may be positioned at an angle 220 with the waistband 202. In some embodiments, the angle 220 may include an angle of about 15 degrees, about 20 degrees, about 25 degrees, about 30 degrees, about 35 degrees, about 36 degrees, about 37 degrees, about 38 degrees, about 39 degrees, about 40 degrees, about 41 degrees, about 42 degrees, about 43 degrees, about 44 degrees, about 45 degrees, about 50 degrees, about 55 degrees, about 60 degrees, about 65 degrees, about 70 degrees, and/or any value between the aforementioned values.

In some embodiments, an opening 217B to the second pocket 216B may be positioned between the opening 217A of the first pocket 216A and a bottom 222A of the first pocket 216A. In some embodiments, a bottom 222B of the second pocket 216B may be positioned below the bottom 222A of the first pocket 216A. In some embodiments, a width 224A of the first pocket 216A may be larger than a width 224B of the second pocket 216B.

In some embodiments, as shown in FIG. 2A, the leg portions 204 may include reinforced portions 226. The reinforced portions 226 may extend from an ankle band 203 of the leg portions 204. The ankle band 203 can be elastic and fit close against a user's leg to inhibit (e.g., prevent) debris (e.g., dirt, leaves, etc.) from entering the tactical pants through the ankle band 203 and contacting the user's skin. A top edge 226A of the reinforced portions 226 may be positioned so the reinforced portions 226 extend over a portion of the leg portions 204 that aligns with a user's knee. In some embodiments, the reinforced portions 226 may include multiple layers of material. In some embodiments, the reinforced portion 226 may include padding and/or hardshell knee protection. In some embodiments, the padding may be removably insertable or couplable to the reinforced portions 226. In some embodiments, the reinforced portions 226 may include hardshell knee protection coupled to the exterior of the reinforced portions 226. In some embodiments, the reinforced portion 226 may include a durable or tear-resistant material. As shown in FIG. 2B, in some embodiments, the reinforced portions 226 may extend so the reinforced portion 226 cover a portion of the leg portions 204 on the back 215 of the tactical pants 200.

In some embodiments, as shown in FIG. 2B, the leg portions 204 may include vent portions 228. The vent portions 228 may include a mesh material and/or any other ventilated material. In some embodiments, the vent portions 228 may be elastic or stretchable. The vent portions 228 may allow air and/or heat trapped between the tactical pants 200 and a user's legs to pass through the vent portions 228 in order to cool the user's legs. The vent portion 228 may allow cool air from outside the tactical pants 200 to pass through the vent portions 228 in order to cool the user's legs. In some embodiments, the tactical pants 200 can be water resistant or waterproof.

Figure 2C:
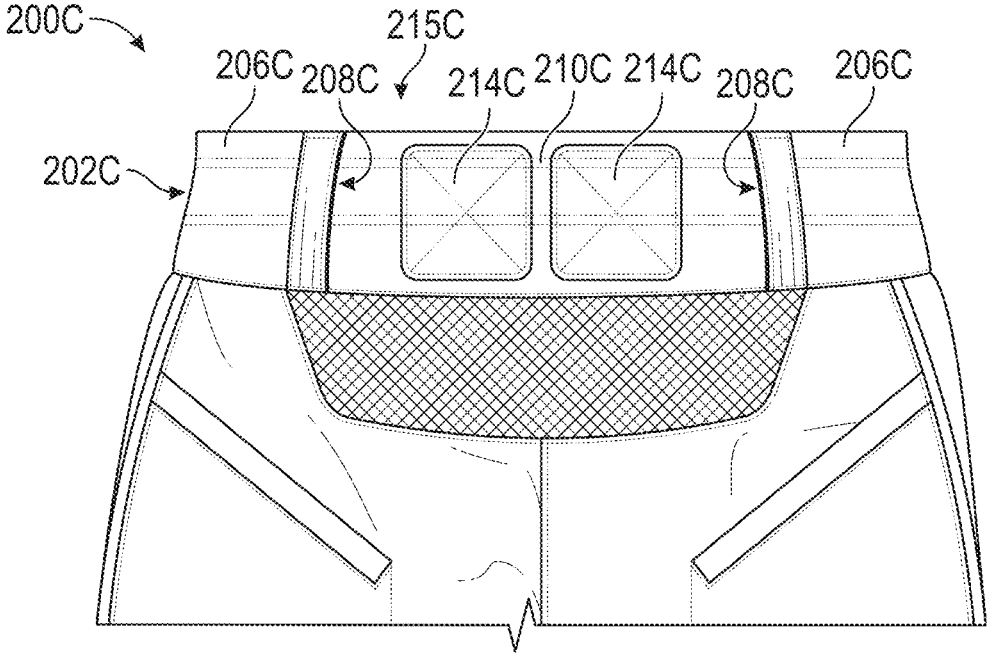
FIG. 2C illustrates another embodiment of tactical pants.

FIG. 2C illustrates another embodiment of tactical pants 200C (e.g., showing a rear view of the tactical pants 200C). The tactical pants 102 of FIGS. 1A and 1B and the tactical pants 200 of FIGS. 2A and 2B may have any of the features of the tactical pants 200C, and the tactical pants 200C may have any of the features of the tactical pants 102 and the tactical pants 200 except for the differences described with reference to FIG. 2C.

In some embodiments, as shown in FIG. 2C, the tactical pants 200C may include panels 206C coupled to a waistband 202C of the tactical pants 200C. The waistband 202C and the panels 206C may form channels 208C. The panels 206C may extend around the waistband 202C except for a portion 210C of the waistband 202C on a back 215C of the tactical pants 200C. The tactical pants 200C may include fasteners 214C. The fasteners 214C may be coupled to the portion 210C of the waistband 202C. The fasteners 214C can be like the fasteners 214 described above (e.g., be or include a magnet, a snap fastener, a button, a buckle, a hook and loop fastener, such as Velcro® hook and loop fastener, and/or any other type of fastener). In some embodiments, the fasteners 214C may include a hook portion of a hook and loop fastener. In other embodiments, the fasteners 214C may include a hoop portion of a hook and loop fastener.

Figure 3A:
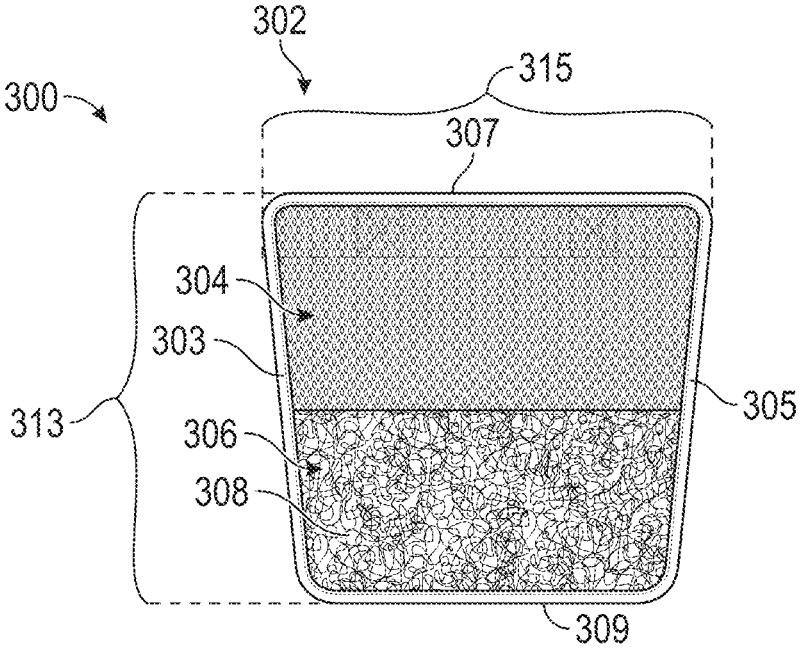
FIG. 3A illustrates a front view of a pad for a tactical harness system.
Figure 3B:
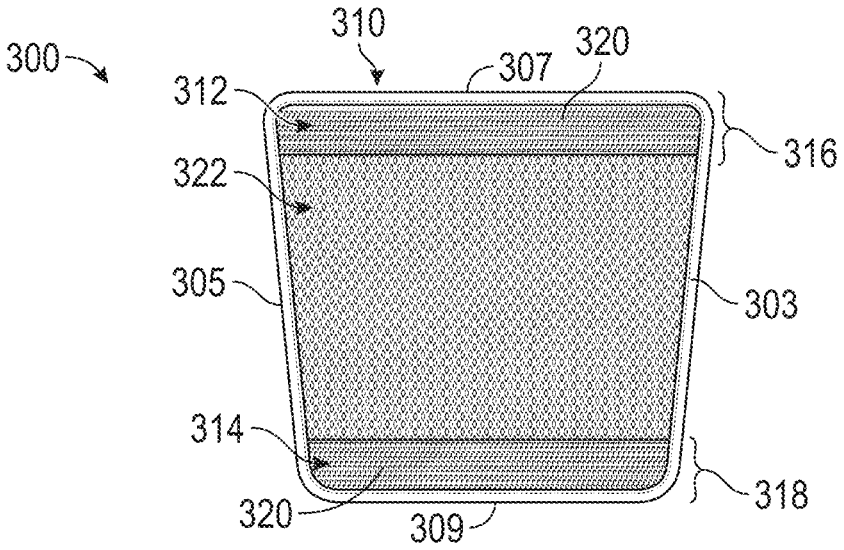
FIG. 3B illustrates a back view of the pad of FIG. 3A.

FIGS. 3A and 3B illustrate an embodiment of a pad 300 for a tactical harness system, such as tactical harness system 100. The pad 106 of FIGS. 1A and 1B may have any of the features of the pad 300, and the pad 300 may have any of the features of the pad 106 except for the differences described with reference to FIGS. 3A and 3B.

As shown in FIG. 3A, the pad 300 may include a front side 302. The front side 302 of the pad 300 may include a padded portion 304 and an attachment portion 306. The padded portion 304 and the attachment portion 306 may extend across the front side 302 of the pad 300 from a first side 303 of the pad 300 to a second side 305 of the pad 300 opposite the first side 303. In some embodiments, the padded portion 304 and/or the attachment portion 306 may extend across a portion of the front side 302 of the pad 300. The padded portion 304 may extend from a first end 307 of the pad 300 to the attachment portion 306. The attachment portion 306 may extend from a second end 309 of the pad 300 opposite first end 307 of the pad 300 to the padded portion 304.

In some embodiments, the padded portion 304 may include a mesh material and/or any other ventilated material. In some embodiments, the padded portion 304 may include padding. The padding of the padded portion 304 may include gel, foam, rubber, and/or any other material used for padding.

In some embodiments, the attachment portion 306 may include a fastener 308. The fastener 308 may be sewn, glued, and/or otherwise coupled to the attachment portion 306. In some embodiments, the attachment portion 306 may include one (1) fastener 308, two (2) fasteners 308, three (3) fasteners 308, four (4) fasteners 308, five (5) fasteners 308, six (6) fasteners 308, seven (7) fasteners 308, eight (8) fasteners 308, nine (9) fasteners 308, and/or ten (10) fasteners 308. The fastener 308 may include a magnet, a snap fastener, a button, a buckle, a hook and loop fastener, such as Velcro® hook and loop fastener, and/or any other type of fastener. In some embodiments, the fastener 308 may include a loop portion of a hook and loop fastener. In some embodiments, the fastener 308 may include a hook portion of a hook and loop fastener.

As shown in FIG. 3B, the pad 300 may include a back side 310 opposite the front side 302. The back side 310 of the pad 300 may include a first attachment portion 312 and/or a second attachment portion 314. The first attachment portion 312 of the back side 310 may be positioned at or proximate the first end 307 of the pad 300. The second attachment portion 314 of the back side 310 may be positioned at or proximate the second end 309 of the pad 300. The first attachment portion 312 and/or the second attachment portion 314 may extend across the back side 310 from the first side 303 of the pad 300 to the second side 305 of the pad 300. In some embodiments, the first attachment portion 312 may include a height 316 and/or the second attachment portion 314 may include a height 318. In some embodiments, the height 316 of the first attachment portion 312 may be a same distance as the height 318 of the second attachment portion 314, and may be smaller than a height of the attachment portion 306 on the front side 302 of the pad 300. In some embodiments, the height 316 of the first attachment portion 312 may be larger than or less than the height 318 of the second attachment portion 314. In some embodiments, the height 316 of the first attachment portion 312 and/or the height 318 of the second attachment portion 314 may include a distance of about 1 cm, about 1.5 cm, about 2 cm, about 2.5 cm, about 2.6 cm, about 2.7 cm, about 2.8 cm, about 2.9 cm, about 3 cm, about 3.1 cm, about 3.2 cm, about 3.3 cm, about 3.4 cm, about 3.5 cm, about 3.6 cm, about 3.7 cm, about 3.8 cm, about 3.9 cm, about 4 cm, about 4.5 cm, about 5 cm, about 5.5 cm, about 6 cm, about 6.5 cm, about 7 cm, about 7.5 cm, about 8 cm, about 8.5 cm, about 9 cm, about 9.5 cm, about 10 cm, about 10.5 cm, about 11 cm and/or any other value between the aforementioned values. In some embodiments, the first attachment portion 312 and/or the second attachment portion 314 may extend from the first end 307 to the second end 309 of the pad 300. In some embodiments, the first attachment portion 312 and/or the second attachment portion 314 may extend across the entire back side 310 of the pad 300.

In some embodiments, the first attachment portion 312 and/or the second attachment portion 314 may include fasteners 320. The fasteners 320 may be sewn, glued, and/or otherwise coupled to the first attachment portion 312 and/or the second attachment portion 314. In some embodiments, the first attachment portion 312 and/or the second attachment portion 314 may include one (1) fastener 320, two (2) fasteners 320, three (3) fasteners 320, four (4) fasteners 320, five (5) fasteners 320, six (6) fasteners 320, seven (7) fasteners 320, eight (8) fasteners 320, nine (9) fasteners 320, and/or ten (10) fasteners 320. The fasteners 320 may include a magnet, a snap fastener, a button, a buckle, a hook and loop fastener, such as Velcro® hook and loop fastener, and/or any other type of fastener. In some embodiments, the fasteners 320 may include a hook portion of a hook and loop fastener. In some embodiments, the fasteners 320 may include a loop portion of a hook and loop fastener.

In some embodiments, the back side 310 of the pad 300 may include a padded portion 322 between the first attachment portion 312 and the second attachment portion 314. In some embodiments, the padded portion 322 may include a mesh material and/or any other ventilated material. In some embodiments, the padded portion 322 may include padding. The padding of the padded portion 322 may include gel, foam, rubber, and/or any other material used for padding.

In some embodiments, a distance 313 between the first end 307 and the second end 309 of the pad 300 may include a distance of about 10 cm, about 10.5 cm, about 11 cm, about 11.5 cm, about 12 cm, about 12.5 cm, about 13 cm, about 13.5 cm, about 14 cm, about 14.5 cm, about 15 cm, about 15.5 cm, about 16 cm, about 16.5 cm, about 17 cm, about 17.5 cm, about 18 cm, about 18.5 cm, about 19 cm, about 19.5 cm, about 20 cm, about 20.5 cm, about 21 cm, about 21.5 cm, about 22 cm, about 22.5 cm, about 23 cm, about 23.5 cm, about 24 cm, about 24.5 cm, about 25 cm, about 25.5 cm, about 26 cm, about 26.5 cm, about 27 cm, about 27.5 cm, about 28 cm, about 28.5 cm, about 29 cm, about 29.5 cm, about 30 cm, about 35 cm, about 40 cm, about 45 cm, about 50 cm, about 100 cm and/or any value between the aforementioned values. In some embodiments, a distance 315 between the first side 303 and the second side 305 of the pad 300 may include a distance of about 10 cm, about 10.5 cm, about 11 cm, about 11.5 cm, about 12 cm, about 12.5 cm, about 13 cm, about 13.5 cm, about 14 cm, about 14.5 cm, about 15 cm, about 15.5 cm, about 16 cm, about 16.5 cm, about 17 cm, about 17.5 cm, about 18 cm, about 18.5 cm, about 19 cm, about 19.5 cm, about 20 cm, about 20.5 cm, about 21 cm, about 21.5 cm, about 22 cm, about 22.5 cm, about 23 cm, about 23.5 cm, about 24 cm, about 24.5 cm, about 25 cm, about 25.5 cm, about 26 cm, about 26.5 cm, about 27 cm, about 27.5 cm, about 28 cm, about 28.5 cm, about 29 cm, about 29.5 cm, about 30 cm, about 35 cm, about 40 cm, about 45 cm, about 50 cm, about 100 cm and/or any value between the aforementioned values.

Figure 3C:
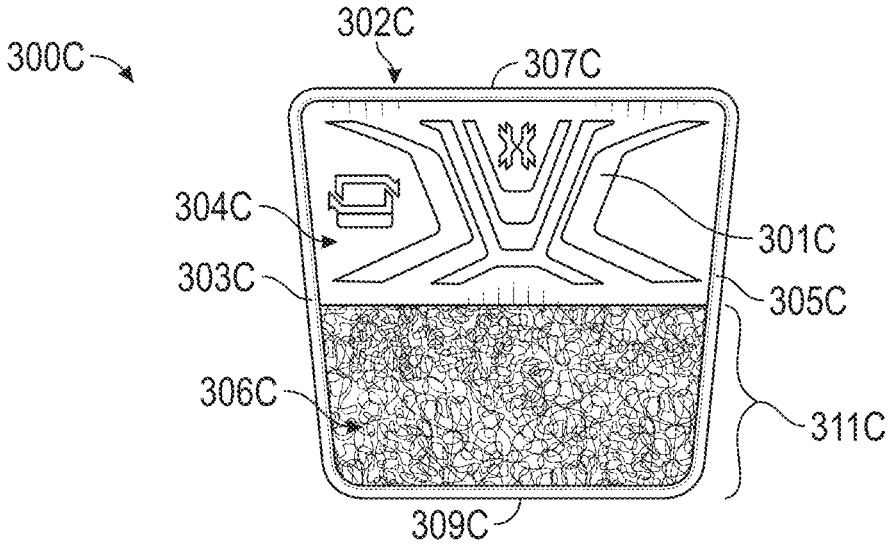
FIG. 3C illustrates a front view of another pad for a tactical harness system.

FIG. 3C illustrates another embodiment of a pad 300C. The pad 106 of FIGS. 1A and 1B and the pad 300 of FIGS. 3A and 3B may have any of the features of the pad 300C, and the pad 300C may have any of the features of the pad 106 and the pad 300 except for the differences described with references to FIG. 3C.

In some embodiments, as shown in FIG. 3C, the pad 300C may include a textured material, an anti-slip material, smooth material, silicone, and/or any other suitable material. In some embodiments, the pad 300C may include one or more graphics 301C. The one or more graphics 301C may be screen printed or otherwise applied to the pad 300C. In some embodiments, the pad 300C may include an attachment portion 306C. The attachment portion 306C may be positioned on a front side 302C of the pad 300C. The attachment portion 306C may extend across the front side 302C of the pad 300C from a first side 303C of the pad 300C to a second side 305C of the pad 300C opposite the first side 303C. In some embodiments, the attachment portion 306C may extend across a portion of the front side 302C of the pad 300C. The attachment portion 306C may extend a distance 311C from a second end 309C of the pad 300C. In some embodiments, the distance 311C may include a distance of about 1 cm, about 1.5 cm, about 2 cm, about 2.5 cm, about 2.6 cm, about 2.7 cm, about 2.8 cm, about 2.9 cm, about 3 cm, about 3.1 cm, about 3.2 cm, about 3.3 cm, about 3.4 cm, about 3.5 cm, about 3.6 cm, about 3.7 cm, about 3.8 cm, about 3.9 cm, about 4 cm, about 4.5 cm, about 5 cm, about 5.5 cm, about 6 cm, about 6.5 cm, about 7 cm, about 7.5 cm, about 8 cm, about 8.5 cm, about 9 cm, about 9.5 cm, about 10 cm, about 10.5 cm, about 11 cm, about 11.5 cm, about 12 cm, about 12.5 cm, about 13 cm, about 13.5 cm, about 14 cm, about 14.5 cm, about 15 cm, about 20 cm, about 25 cm, and/or any other value between the aforementioned values.

In some embodiments, the pad 300C may include padding (not shown). The padding may be positioned in the pad 300C. The padding may extend from a first end 307C of the pad 300C to the second end 309C of the pad 300C. The padding may extend from the first side 303C of the pad 300C to the second side 305C of the pad 300C. Accordingly, the padding may extend across the entire pad 300C.

Figure 4A:
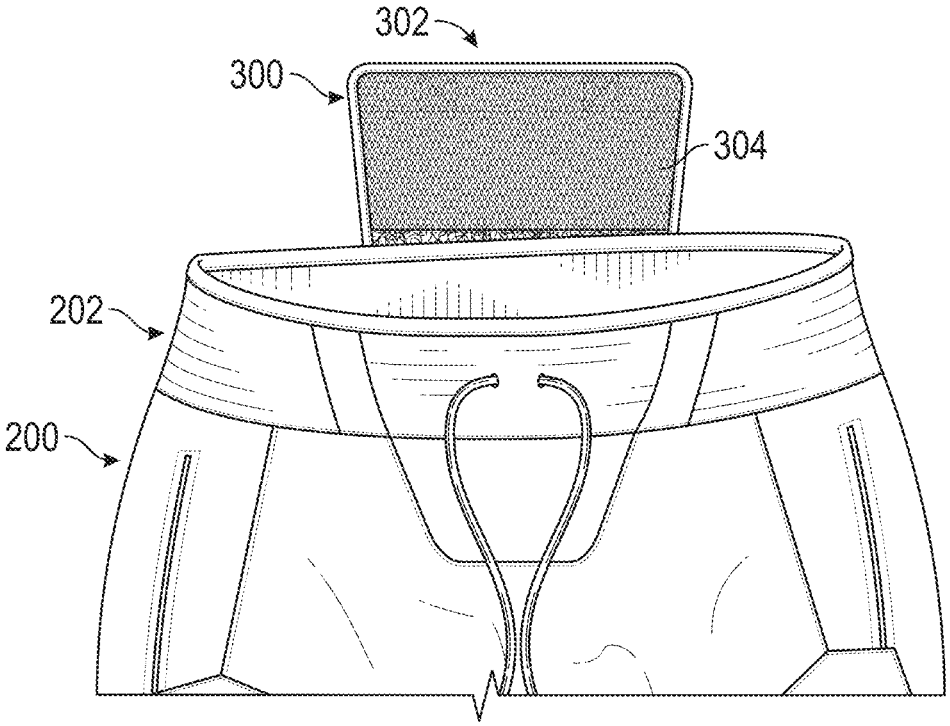
FIG. 4A illustrates a front view of a pad attached to tactical pants.
Figure 4B:
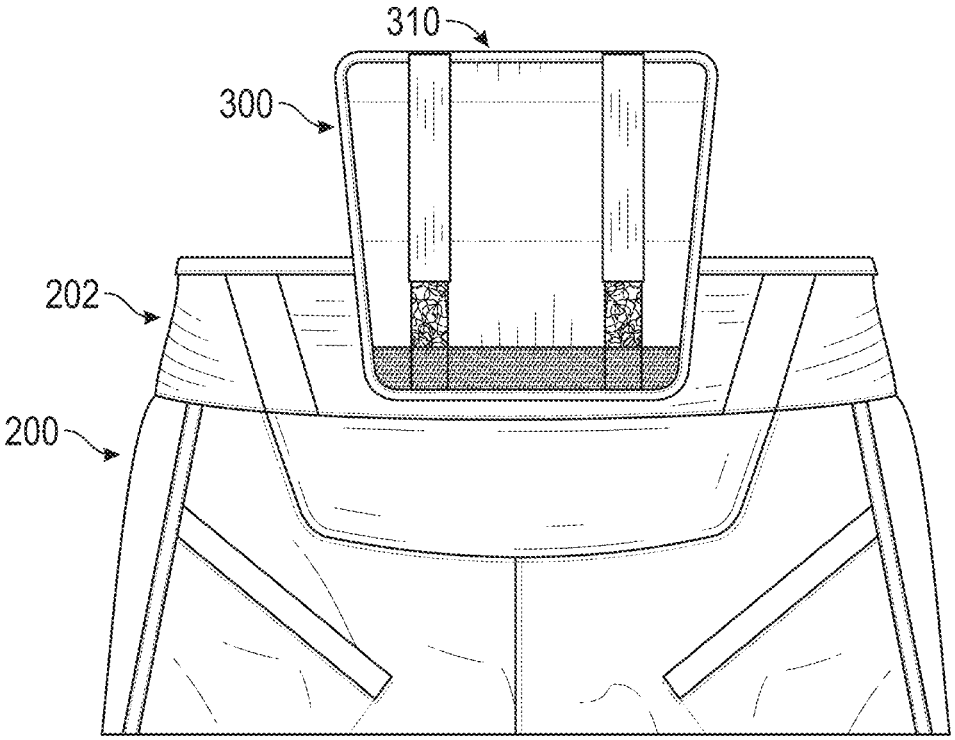
FIG. 4B illustrates a back view of the pad of FIG. 4A attached to the tactical pants of FIG. 4A.

FIGS. 4A and 4B illustrate the tactical pants 200 with the pad 300 coupled to the tactical pants 200. The pad 300 may be coupled to the waistband 202 of the tactical pants 200. The fastener 308 of the attachment portion 306 (shown in FIG. 3A) of the pad 300 may be coupled to the fasteners 214

(shown in FIG. 2B) of the tactical pants 200. The pad 300 may be positioned so the front side 302 faces the waistband 202 of the tactical pants 200 (on the back side of the tactical pants 200). The pad 300 may be positioned so the back side 310 faces away from the waistband 202 of the tactical pants 200.

In some embodiments, when the pad 300 is coupled to the tactical pants 200, the pad 300 may be positioned so the padded portion 304 is positioned above the waistband 202 of the tactical pants 200. Accordingly, when a user wears the tactical pants 200, the pad 300 may be positioned so the pad 300 covers a portion of a back (e.g., lower back) of a user. The padded portion 304 of the pad 300 may protect the back of the user. In some embodiments, the pad may protect a tailbone of the user.

Figure 5A:
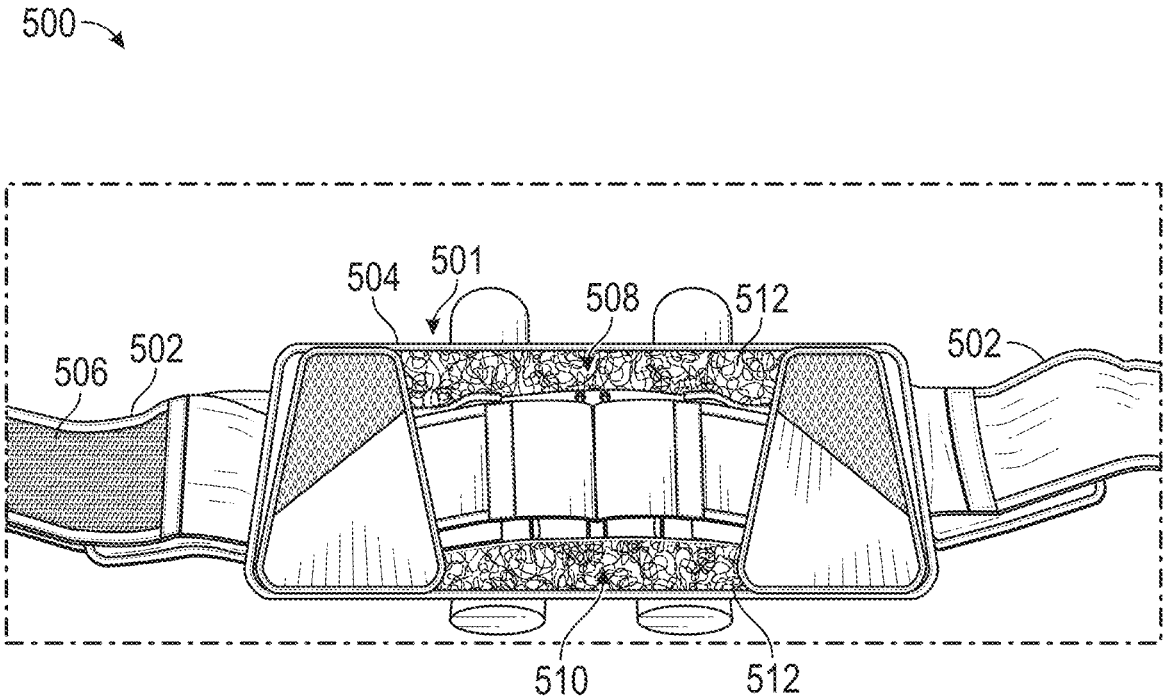
FIG. 5A illustrates a front view of a harness of a tactical harness system.
Figure 5B:
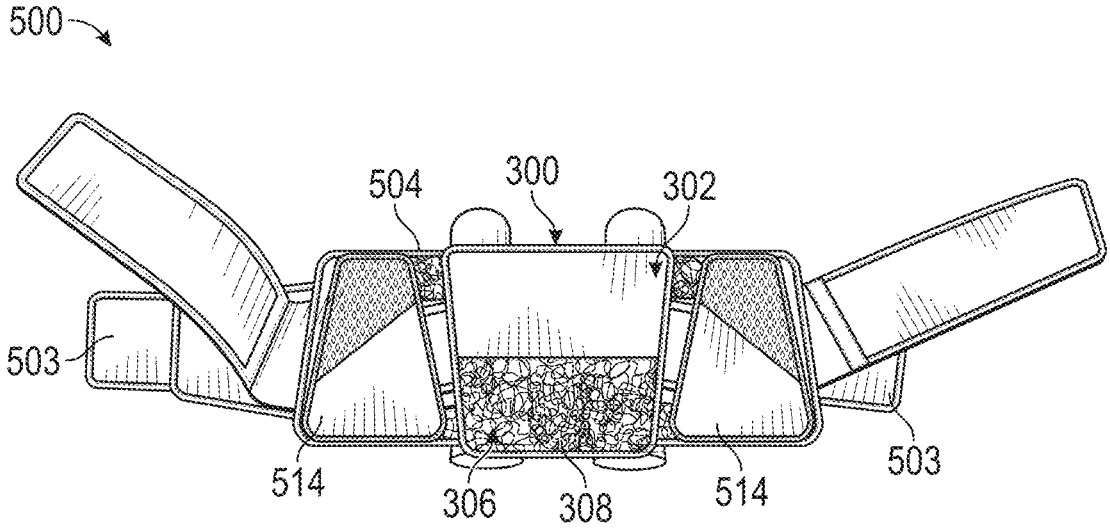
FIG. 5B illustrates a front view of the harness of FIG. 5A with a pad attached to the harness.

FIGS. 5A and 5B illustrate a harness 500 of the tactical pants system, such as tactical harness system 100. The harness 104 in FIGS. 1A and 1B may have any of the features of the harness 500, and the harness 500 may have any of the features of harness 104 except the differences described with reference to FIGS. 5A and 5B. FIG. 5A illustrates the harness 500. FIG. 5B illustrates the harness 500 with the pad 300 coupled to the harness 500.

In some embodiments, as shown in FIG. 5A, the harness 500 may include a backplate 504 and/or straps 502. The straps 502 may extend from the backplate 504. The straps 502 may be positioned around a waist or abdomen of a user and/or a waistband of pants, such as tactical pants 102, 200. The straps 502 may secure the harness 500 to the user and/or the waist of the user. In some embodiments, as shown in FIG. 5A, the straps 502 may include fasteners 506. The fasteners 506 may be sewn, glued, and/or otherwise coupled to the straps 502. The straps 502 may each include one (1) fastener 506, two (2) fasteners 506, three (3) fasteners 506, four (4) fasteners 506, five (5) fasteners 506, six (6) fasteners 506, seven (7) fasteners 506, eight (8) fasteners 506, nine (9) fasteners 506, and/or ten (10) fasteners 506. The fastener 506 may be continuous along the length of the straps 502. The fasteners 506 may include a magnet, a snap fastener, a button, a buckle, a hook and loop fastener, such as Velcro® hook and loop fastener, and/or any other type of fastener. The fasteners 506 of each strap 502 may be coupled together (e.g., to each other) to secure the straps 502 and/or the harness 500 around the waist or abdomen of the user and/or the waistband of pants, such as tactical pants 102, 200.

In some embodiments, the backplate 504 of the harness 500 may include a first side 501. The first side 501 may face a user (e.g., a back side of the user) when the harness 500 is secured to the user. The first side 501 may include a first attachment portion 508 and/or a second attachment portion 510. The first attachment portion 508 and/or the second attachment portion 510 may include fasteners 512. The fastener 512 may be sewn, glued, and/or otherwise coupled to the first attachment portion 508 and/or the second attachment portion 510. In some embodiments, the first attachment portion 508 and/or the second attachment portion 510 may include one (1) fastener 512, two (2) fasteners 512, three (3) fasteners 512, four (4) fasteners 512, five (5) fasteners 512, six (6) fasteners 512, seven (7) fasteners 512, eight (8) fasteners 512, nine (9) fasteners 512, and/or ten (10) fasteners 512. The fasteners 512 may include a magnet, a snap fastener, a button, a buckle, a hook and loop fastener, such as Velcro® hook and loop fastener, and/or any other type of fastener. In some embodiments, the fasteners 512 may include a hook portion of a hook and loop fastener. In some embodiments, the fasteners 512 may include a loop portion of a hook and loop fastener. In some embodiments, the first attachment portion 508 and/or the second attachment portion 510 may be (removably) coupled to fasteners (e.g., fasteners 103, 214, 214C) on the waistband of the tactical pants.

In some embodiments, the first attachment portion 508 and/or the second attachment portion 510 may be positioned on the backplate 504 of the harness 500 such that the when the pad 300 is positioned on the backplate 504 of the harness 500, as shown in FIG. 5B, the first attachment portion 312 of the pad 300 (shown in FIG. 3B) aligns with and (removably) couples to the first attachment portion 508 of the backplate 504 of the harness 500 and/or the second attachment portion 314 of the pad 300 (shown in FIG. 3B) aligns with and (removably) couples to the second attachment portion 510 of the backplate 504 of the harness 500. Accordingly, the fasteners 320 (shown in FIG. 3A) of the first and second attachment portions 312, 314 of the pad 300 may be coupled with the fasteners 512 of the first and second attachment portions 508, 510 of the backplate 504 of the harness 500.

As shown in FIG. 5B, when the pad 300 is coupled to the harness 500, the front side 302 of the pad 300 may face away from the harness 500. When the harness 500 is positioned around the waist of the user, the front side 302 of the pad 300 may face the user (e.g., the back side of the user) and/or the waistband of tactical pants, such as tactical pants 200. Accordingly, the fastener 308 of the attachment portion 306 on the front side 302 of the pad 300 may be (removably) coupled to fasteners (e.g., fasteners 103, 214, 214C) on the waistband of the tactical pants so that the pad 300 is positioned between the backplate 504 of the harness 500 and the tactical pants 200. The pad 300 may prevent or inhibit the harness 500 from moving (up or down) or rotating (left or right) relative to the waistband of the tactical pants and/or the waist of the user. Coupling the harness 500 to fasteners (e.g., fasteners 103, 214, 214C) on the waistband of the tactical pants via the first attachment portion 508 and/or the second attachment portion 510 directly or via the pad 300 may advantageously maintain the harness 500 in place during use and allow the user to focus on the game instead of having to adjust the position of the harness 500 due to it shifting relative to the tactical pants 200.

In some embodiments, the backplate 504 of the harness 500 may include padding 514 on the first side 501. The padding 514 may be positioned on the backplate 504 so the padding 514 is positioned on either side of the pad 300 when the pad 300 is coupled to the backplate 504.

In some embodiments, the harness 500 may include secondary straps 503. The secondary straps 503 may extend from the backplate 504. In some embodiments, the secondary straps 503 may be removably coupled to the backplate 504 and the secondary straps 503 may be inserted through holes in the backplate 504. The harness 500 may include one (1) secondary strap 503, two (2) secondary straps 503, three (3) secondary straps 503, four (4) secondary straps 503, five (5) secondary straps 503, six (6) secondary straps 503, seven (7) secondary straps 503, eight (8) secondary straps 503, nine (9) secondary straps 503, and/or ten (10) secondary straps 503. The secondary straps 503 may be coupled to the straps 502 when the straps 502 are positioned around the waist of the user and/or the waistband of tactical pants. In some embodiments, the secondary straps 503 may improve securement of the harness 500 around the waist of the user and/or the waistband of tactical pants. The secondary straps 503 may reduce or minimize movement (up or down) or rotation (left or right) of the harness 500 relative to the waistband of the tactical pants and/or the waist of the user. The secondary straps 503 may increase a weight the harness 500 may hold while positioned around the waist of the user and/or the waistband of tactical pants.

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

Of course, the foregoing description is that of certain features, aspects and advantages of the present invention, to which various changes and modifications can be made without departing from the spirit and scope of the present invention. Moreover, the devices described herein need not feature all of the objects, advantages, features and aspects discussed above. Thus, for example, those of skill in the art will recognize that the invention can be embodied or carried out in a manner that achieves or optimizes one advantage or a group of advantages as taught herein without necessarily achieving other objects or advantages as may be taught or suggested herein. In addition, while a number of variations of the invention have been shown and described in detail, other modifications and methods of use, which are within the scope of this invention, will be readily apparent to those of skill in the art based upon this disclosure. It is contemplated that various combinations or subcombinations of these specific features and aspects of embodiments may be made and still fall within the scope of the invention. Accordingly, it should be understood that various features and aspects of the disclosed embodiments can be combined with or substituted for one another in order to form varying modes of the discussed devices.

What is claimed is:

1. A tactical harness system comprising:

a harness comprising:

a backplate;

straps extending from the backplate and configured to wrap around a user's waist; and one or more equipment fasteners configured to couple equipment to the harness;

a pad configured to removably couple to the backplate of the harness, wherein the pad comprises a fastener configured to couple the pad to fasteners on a back portion of a waistband of tactical pants when the straps of the harness are positioned around the user's waist, such that the pad is positioned between the waistband and the backplate of the harness.

2. The tactical harness system of claim 1, wherein the fastener of the pad comprises a hook and loop fastener.

3. The tactical harness system of claim 1, wherein the harness comprises a fastener configured to removably couple the pad to the harness.

4. The tactical harness system of claim 3, wherein the fastener of the pad is a first fastener positioned on a first side of the pad, wherein the pad comprises a second fastener on a second side of the pad, and wherein the second fastener is configured to removably couple with the fastener of the harness.

5. The tactical harness system of claim 1, wherein the pad comprises a third fastener and the harness comprises a second fastener, and wherein the third fastener of the pad is configured to couple with the second fastener of the harness.

6. The tactical harness system of claim 1, wherein the pad covers a portion of a back of a user when the pad is coupled to the waistband of the tactical pants.

7. The tactical harness system of claim 1, wherein the harness comprises padding.

8. The tactical harness system of claim 1, wherein the backplate is wider than the pad.

9. The tactical harness system of claim 1, wherein the backplate comprises padding positioned on either side of the pad when the pad is coupled to the backplate.

10. A tactical harness system comprising:

a harness comprising straps configured to wrap around a user to couple the harness to the user, a backplate having a first attachment portion, and one or more equipment fasteners configured to couple equipment to the harness;

a pad comprising a second attachment portion and a third attachment portion;

pants comprising a waistband and a fastener positioned on a back portion of the waistband, wherein the first attachment portion is configured to couple with the second attachment portion to couple the pad to the backplate of harness, and wherein the third attachment portion is configured to couple with the fastener of the pants to couple the pad to the pants between the backplate and the waistband of the pants.

11. The tactical harness system of claim 10, wherein the first attachment portion, the second attachment portion, and the third attachment portion comprise hook and loop fasteners.

12. The tactical harness system of claim 11, wherein the first attachment portion and the third attachment portion each comprise a loop portion of a hook and loop fastener, and the second attachment portion and the fastener each comprise a hook portion.

13. The tactical harness system of claim 10, wherein the pad aligns with a lower back of the user when the pad is coupled to the pants.

14. The tactical harness system of claim 10, wherein the backplate is wider than the pad.

15. The tactical harness system of claim 10, wherein the backplate comprises padding positioned on either side of the pad when the pad is coupled to the backplate.

* * * * *